United States Patent [19]

Gelse et al.

[11] Patent Number: 4,522,568

[45] Date of Patent: Jun. 11, 1985

[54] COMPRESSOR APPARATUS

[75] Inventors: Hans-Dieter Gelse, Wunstrof; Werner Heger, Lehrte; Manfred Kramer, Barsinghausen, all of Fed. Rep. of Germany

[73] Assignee: WABCO Fahrzeugbremsen GmbH, Hanover, Fed. Rep. of Germany

[21] Appl. No.: 479,601

[22] Filed: Mar. 28, 1983

[30] Foreign Application Priority Data

Apr. 21, 1982 [DE] Fed. Rep. of Germany ..... 3214713

[51] Int. Cl.[3] ..... F04B 49/08

[52] U.S. Cl. ..... 417/307; 417/308

[58] Field of Search ..... 417/283, 307, 308, 311, 417/296, 298

[56] References Cited

U.S. PATENT DOCUMENTS

| | | | |
|---|---|---|---|
| 718,132 | 1/1903 | Lamplough | 417/307 |
| 1,810,540 | 6/1931 | Thomas | 417/307 |
| 2,626,100 | 1/1953 | McIntyre | 417/298 |
| 4,408,967 | 10/1983 | Unger et al. | 417/311 X |

FOREIGN PATENT DOCUMENTS

| | | | |
|---|---|---|---|
| 451612 | 10/1948 | Canada | 417/307 |
| 982927 | 2/1965 | United Kingdom | 417/307 |

*Primary Examiner*—William L. Freeh
*Assistant Examiner*—T. Olds
*Attorney, Agent, or Firm*—A. G. Williamson, Jr.

[57] ABSTRACT

A valve plate, inserted between the cylinder body and head parts of a compressor, holds the usual compression valve, which opens to connect the compression and pressure chambers during the compression stroke of the piston, and the suction valve which opens to connect the suction and compression chambers during the piston intake stroke. A separate plate-type idle valve also within the plate is positioned to open into a recess of the compression chamber so that there is no interference with the movement of the piston. The idle valve is controlled by an idle piston actuated by pressurized air admitted through a pressure regulator which opens when the reservoir pressure exceeds a predetermined level. Opening the idle valve shifts the compressor operation from compression to idle condition by permitting unhindered passage of air between suction and compression chambers.

9 Claims, 3 Drawing Figures

COMPRESSOR APPARATUS

BACKGROUND OF THE INVENTION

The invention relates to compressor apparatus for the production of compressed gas, especially for a pneumatic brake installation.

A type of compressor apparatus is described in connection with a pneumatic brake in German Patent Application P 31 36 948.0, published in Germany on Mar. 31, 1983. In this apparatus, a pressure regulation apparatus, a so called governor which is responsive to the pressure within the reservoir is used, among other things, to switch over the compression phase of the air compressor operation into an idle phase. The pressure regulation valve apparatus, connected between the reservoir and the suction portion of the compressor, when a predetermined reservoir pressure is surpassed, switches so that a piston located in the cylinder head of the compressor is acted upon by compressed air. The stroke movement of this piston which is thereby triggered pushes open the suction valve of the compressor by means of a piston tappet. As a result of this open connection made between the suction chamber and the compression chamber of the compressor, the latter conveys no compressed air during the idle phase. This continues until there is a predetermined drop in the reservoir pressure, when the pressure regulation valve apparatus reverses and the piston returns to its initial position as a result of the cessation of pressurization, so that the suction valve in the transport phase can once again exercise its normal function.

It is also known that, in compressors, the use of plate valves is more advantageous than the common use of disc valves, since with the same valve clearance volume, the plate valves make available a greater admission cross section than the disc valves. The advantages of a larger admission cross section include lower suction losses and a greater efficiency of the compressor. The use of suction valves of the preferable plate valve design presents no problems at all, if the compressor is so arranged that the reservoir pressure is regulated by means of a valve apparatus in which, in a known manner, a pressure which surpasses a predetermined pressure level is exhausted into the atmosphere. In other words, the compressor continues to produce compressed air in the idle phase so that the suction valve retains its normal function during this phase.

A phate valve which opens during the suction process of the compressor has its plate projecting into the compression chamber and, during the compression process, is again pushed out of the compression chamber and out of the piston stroke area of the piston, onto its valve seat in the closed position. In the normal compression phase and during an idle phase of the compressor in which the excess pressure is vented into the atmosphere, a plate-type suction valve creates no problems. However, when the pressure is regulated by means of a governor and the suction valve is held open during the idle phase, measures must be taken which prevent the piston, when moving upward, from striking the valve plate which projects into the compression chamber. That is, the space above the piston, in its topmost stroke position, must exhibit a correspondingly greater height. The consequence of this is a significant decrease in efficiency, an elongated design of the compressor, and longer filling times for the apparatus. For this reason, the lesser of two evils has been accepted and the suction valves are designed as disc valves.

The object of the invention, therefore, is the creation of compressor apparatus of the type described in which, in spite of pressure regulation by means of a governor, the suction valve of the compressor can be designed as a plate valve.

SUMMARY OF THE INVENTION

In the compressor apparatus disclosed by the invention, a connection is advantageously made between the suction chamber and the compression chamber, during the idle phase, which lies outside the piston area. This makes possible the use of a suction valve designed as a plate valve, since the valve plate in the idle phase can execute the same opening and closing movements as in the compression phase. As a result of the additional valve in the idle valve apparatus, the rate of admission of the compressor is also improved.

BRIEF DESCRIPTION OF THE DRAWINGS

The invention will now be described in more detail, with reference to the examples of its specific designs illustrated in the accompanying drawings, in which.

In each of the drawing figures, the same or similar parts of the apparatus are designated by similar references.

DESCRIPTION OF THE ILLUSTRATED EMBODIMENTS

Figure 1:
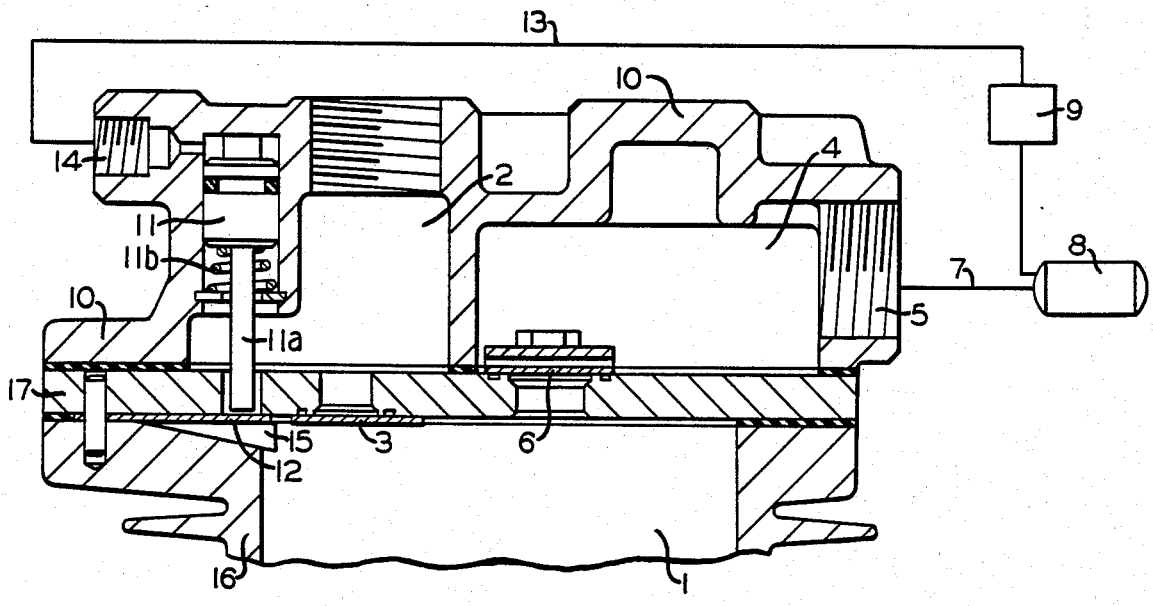
FIG. 1 shows an air compressor apparatus with pressure regulation by means of a governor and an idle valve apparatus arrangement, whose idle valve is located in a recess of the compression chamber outside the cylinder bore.

The apparatus for the production of compressed gas, e.g., air, shown in FIG. 1 consists of a compressor, shown in cross section, a compressed gas storage reservoir 8, and a pressure-regulation apparatus 9, consisting of a governor which is represented schematically. The cross-section of the compressor shows the portion of a cylinder 16 with a compression chamber 1, a cylinder head 10 with a suction chamber 2 and a pressure chamber 4, and a valve plate 17 located between the cylinder 16 and the cylinder head 10. The main piston which moves reciprocally vertically within compression chamber 1 is not shown. The valve plate 17 supports a plate-type suction valve 3 connecting the suction chamber 2 and the compression chamber 1, as well as a pressure valve 6 connecting the compression chamber 1 and the pressure chamber 4. A compressed air outlet 5 of the cylinder head 10 makes a connection between the pressure chamber 4 and the compressed gas storage reservoir 8, by means of a conventionally shown line 7.

Figure 3:
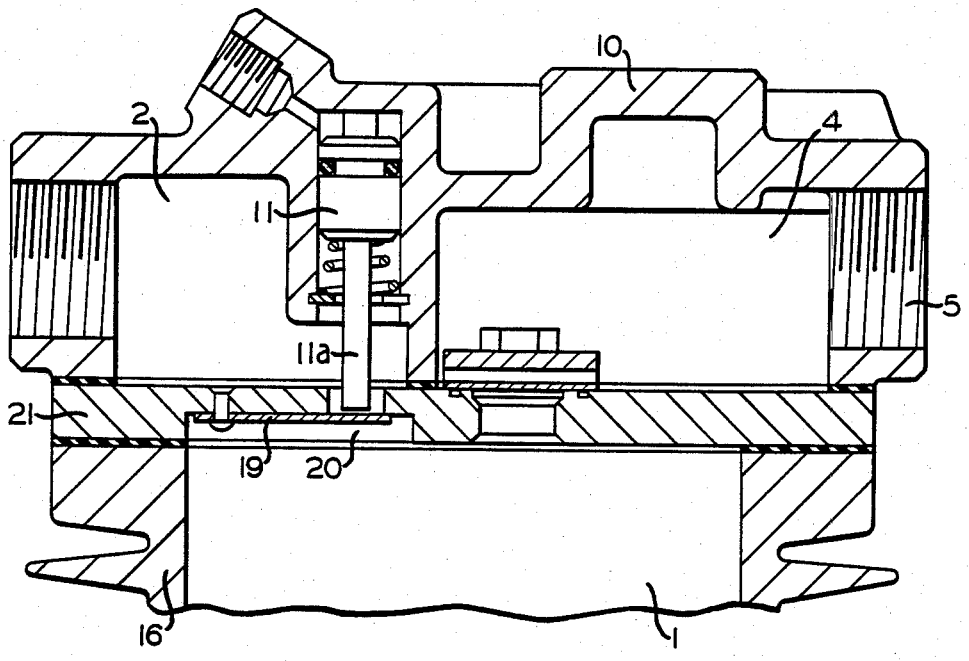
FIG. 3 shows a portion of the compressor illustrated in FIG. 2 but with its idle valve located in a recess in the compression chamber inside the cylinder bore.

The valve plate 17 supports an idle valve 12 which is shown in FIGS. 1 and 3 as a plate-type valve connecting the suction chamber 2 and the compression chamber 1, which idle valve 12 is part of an idle valve apparatus 11, 12. The idle valve 12 is positioned outside the cylindrical compression chamber 1 formed by the cylinder bore 16, in a recess 15 of the cylinder 16 which is connected in this arrangement with the compression chamber 1. As shown in FIG. 1, the idle valve 12 is held in place by a pin adjacent one end thereof. Obviously in order for the idle valve 12 to open and close it must be manufactured from a material possessing some elastic quality. The idle valve apparatus 11, 12 includes an idle piston 11 with a tappet 11*a* for the activation of the idle valve 12 in the same opening direction as the suction valve 3. The idle piston 11 can be pressurized with compressed air. For this purpose, there exists a connection with the pressure-regulation apparatus 9, controlled by the reservoir pressure, by means of a line 13 and a compressed air inlet port 14 in the cylinder head 10. The tension of a spring 11*b* acts on the idle piston 11 in the closing direction of the idle valve 12.

Figure 2:
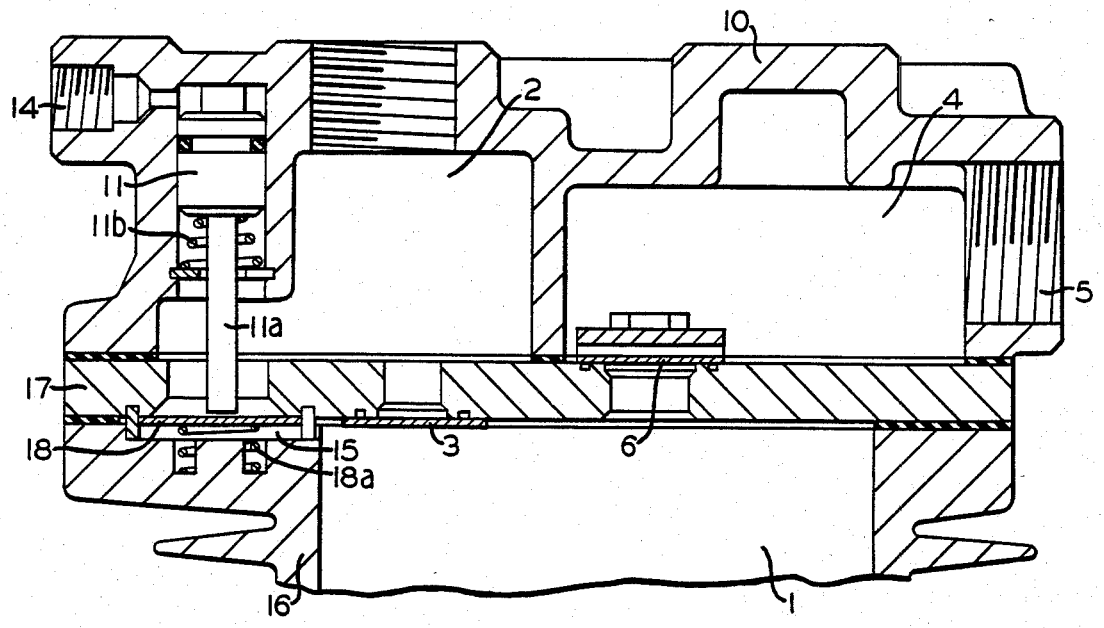
FIG. 2 shows a portion of a compressor as illustrated in FIG. 1 but with an idle valve designed as a disc valve.

As shown in FIG. 2, the idle valve consists of a disc type valve 18, whose disc is acted on in the valve-closing direction by the tension of a spring 18*a*, which can be designed advantageously so that during the compression phase of the compressor, the valve 18 either does not open or opens only partly, which can mean an improvement in the service life of the valve. The components shown in FIG. 2 are numbered according to the same system used in FIG. 1. In both FIG. 2 and FIG. 3, the schematic illustration of the components connected with the compressor has been omitted.

FIG. 3 shows another example, in which the idle valve is designed as a plate-type valve 19 in a recess 20 of the valve plate 21 inside the cylindrical compression chamber 1 formed by the bore of the cylinder 16. As shown in this Figure, the plate-type valve 19 is held in place by a pin adjacent one end thereof and as with the plate-type valve 12 shown in FIG. 1, valve 19 must be made from a material having an elastic quality. The suction valve does not appear in this sectional drawing. Some of the components already illustrated in FIGS. 1 and 2 are not numbered in FIG. 3.

The operation is now described briefly, with reference to FIG. 1. The description assumes familiarity with the operation of a compressor. After a predetermined pressure produced by the air compressor is reached in the reservoir 8, the governor 9, which has heretofore been in the closed position, reverses and compressed air flows out of the reservoir 8 via the line 13 and the port 14 to the idle piston 11. The resulting stroke movement of piston 11 opens, by means of the tappet 11*a*, the idle valve 12. While the idle valve 12 is in the open position, there is an unhindered exchange of air between the compression chamber 1 and the suction chamber 2, i.e., no compressed air is conveyed through the pressure valve 6 and the pressure chamber 4 into the reservior 8. When valve 12 is open long enough that a preset pressure drop occurs in the reservior 8, the governor switches back again and the now-depressurized idle piston 11 returns to its initial position under the action of the tension of the spring 11*b*. The depressurized idle valve 12 also returns to its closed position with a compression stroke of the compressor piston.

Having thus described the invention, what we claim as new and desire to secure by Letters Patent, is:

1. A compressor apparatus, for producing compressed gas, including a compression chamber within a cylinder body through which a piston moves with reciprocal motion, to periodically compress gas in the chamber, and suction and pressure chambers within the cylinder head, and further comprising:

(a) a valve plate connected between said cylinder body and said cylinder head, said valve plate and said cylinder body and said cylinder head forming a single assembly;

(b) at least one compressed gas communication passageway formed through said valve plate for communicating such compressed gas from said compression chamber into said pressure chamber during a compression stroke of said piston;

(c) a pressure valve means openable into said pressure chamber during said piston compression stroke positioned to sealingly engage said valve plate adjacent said compressed gas communication passageway on said pressure chamber side of said valve plate for closing said compressed gas communication passageway during an intake stroke of said piston and for maintaining said compressed gas communication passageway closed when said compressor apparatus is in an idling condition;

(d) at least one uncompressed gas communication passageway formed through said valve plate for communicating such uncompressed gas from said suction chamber into said compression chamber during such intake stroke of said piston;

(e) a plate-type valve means openable into said compression chamber during said piston intake stroke positioned to sealingly engage said valve plate adjacent said uncompressed gas communication passageway on said compression chamber side of said valve plate for closing said uncompressed gas communication passageway during such compression stroke of said piston;

(f) a compressed gas storage reservoir coupled to receive and store compressed gas from said pressure chamber;

(g) at least one idle phase gas communication passageway formed through said valve plate for communicating uncompressed gas from said suction chamber into said compression chamber and from said compression chamber into said suction chamber during a respective intake stroke and compression stroke of said piston when said compressor apparatus is in such idling condition;

(h) an idle phase valve means positioned to sealingly engage said valve plate adjacent said idle phase gas communication passageway on said compression chamber side of said valve plate for sealably closing said idle phase gas communication passageway at least during such compression stroke of said piston when said compressor apparatus is in an operating condition;

(i) a compressor shifting means for shifting said compressor apparatus from such operating condition to such idling condition;

(j) an idle phase valve opening means connected to said compressor shifting means and positioned within said suction chamber to operatively engage said idle phase valve means through said idle phase gas communication passageway for maintaining said idle phase gas communication passageway continuously open during such idling condition of said compressor apparatus; and (k) a recess area formed adjacent said idle phase valve means on at least one of said cylinder body and said valve plate and in gas communication with said compression chamber for receiving and preventing said idle valve means from interfering with said piston during a compression stroke thereby allowing minimum clearance between the bottom of said valve plate and the top of said piston while at the same time permitting the use of a plate-type suction valve means.

2. Compressor apparatus, as defined in claim 1, wherein said idle phase valve is a disc-type valve.

3. A compressor apparatus, for producing compressed gas, including a compression chamber within a cylinder body through which a piston moves with reciprocal motion, to periodically compress gas in the chamber, and suction and pressure chambers within the cylinder head, and further comprising:

(a) a valve plate connected between said cylinder body and said cylinder head, said valve plate and said cylinder body and said cylinder head forming a single assembly;

(b) at least one compressed gas communication passageway formed through said valve plate for communicating such compressed gas from said compression chamber into said pressure chamber during a compression stroke of said piston;

(c) a pressure valve means openable into said pressure chamber during said piston compression stroke positioned to sealingly engage said valve plate adjacent said compressed gas communication passageway on said pressure chamber side of said valve plate for closing said compressed gas communication passageway during an intake stroke of said piston and for maintaining said compressed gas communication passageway closed when said compressor apparatus is in an idling condition;

(d) at least one uncompressed gas communication passageway formed through said valve plate for communicating such uncompressed gas from said suction chamber into said compression chamber during such intake stroke of said piston;

(e) a plate-type valve means openable into said compression chamber during said piston intake stroke positioned to sealingly engage said valve plate adjacent said uncompressed gas communcation passageway on said compression chamber side of said valve plate for closing said uncompressed gas communication passageway during such compression stroke of said piston;

(f) a compressed gas storage reservoir coupled to receive and store compressed gas from said pressure chamber;

(g) at least one idle phase gas communication passageway formed through said valve plate for communicating uncompressed gas from said suction chamber into said compression chamber and from said compression chamber into said suction chamber during a respective intake stroke and compression stroke of said piston when said compressor apparatus is in such idling condition;

(h) an idle phase plate-type valve means positioned to sealingly engage said valve plate adjacent said idle phase gas communication passageway on said compression chamber side of said valve plate for sealably closing said idle phase gas communication passageway at least during such compression stroke of said piston when said compressor apparatus is in an operating condition;

(i) a compressor shifting means for shifting said compressor apparatus from such operating condition to such idling condition;

(j) an idle phase valve opening means connected to said compressor shifting means and positioned within said suction chamber to operatively engage said idle phase plate-type valve means through said idle phase gas communication passageway for maintaining said idle phase gas communication passageway continuously open during such idling condition of said compressor apparatus; and (k) a recess area formed adjacent said idle phase plate-type valve means on at least one of said cylinder body and said valve plate and in gas communication with said compression chamber for receiving and preventing said idle phase plate-type valve means from interfering with said piston during a compression stroke thereby allowing minimum clearance between the bottom of said valve plate and the top of said piston while at the same time permitting the use of a plate-type suction valve means.

4. Compressor apparatus, as defined in claim 3, wherein said idle valve opening means comprises:

(a) an idle piston operably connected to said idle valve and positioned within a separate chamber in said cylinder head coupled to said compressor shifting means;

(b) said idle piston operating in response to said compressor shifting means when in its open condition for actuating said idle valve to open said idle phase gas communication passageway to shift said compressor apparatus to such idle phase operating condition; and (c) a piston spring positioned within said separate chamber for returning said idle piston to its nonoperated position when said compressor shifting means is in its closed condition.

5. Compressor apparatus, as defined in claim 3, wherein said recess area is formed on said cylinder body.

6. Compressor apparatus, as defined in claim 3, wherein said recess area has a substantially uniform depth.

7. Compressor apparatus, as defined in claim 3, wherein said recess area is triangular in shape.

8. Compressor apparatus, as defined in claim 3, wherein said recess area is formed in said valve plate.

9. Compressor apparatus, as defined in claim 8, wherein said cylinder body further comprises an elongated extension to receive said recess area.

* * * * *

UNITED STATES PATENT AND TRADEMARK OFFICE

CERTIFICATE OF CORRECTION

PATENT NO. : 4,522,568

DATED : June 11, 1985

INVENTOR(S) : Hans-Dieter Gelse et al

It is certified that error appears in the above-identified patent and that said Letters Patent are hereby corrected as shown below:

Column 6, line 54, change "8" to --3--

Signed and Sealed this

*Twenty-fourth* Day of *September 1985*

[SEAL]

*Attest:*

*Attesting Officer*

DONALD J. QUIGG

*Commissioner of Patents and Trademarks—Designate*